US005160570A

United States Patent [19]

Dickey

[11] Patent Number: 5,160,570

[45] Date of Patent: * Nov. 3, 1992

[54] ULTRA HIGH SPEED LABELING APPARATUS

[75] Inventor: Daniel M. Dickey, Denair, Calif.

[73] Assignee: CMS Gilbreth Packaging Systems, Inc., Trevose, Pa.

[ * ] Notice: The portion of the term of this patent subsequent to Sep. 3, 2008 has been disclaimed.

[21] Appl. No.: 697,192

[22] Filed: May 8, 1991

Related U.S. Application Data

[63] Continuation of Ser. No. 345,447, Apr. 28, 1989, Pat. No. 5,045,140.

[51] Int. Cl.[5] ..... B65C 9/04; B65C 9/20

[52] U.S. Cl. ..... 156/448; 118/231; 118/259; 118/261; 156/458; 156/566; 156/568; 156/578; 156/DIG. 13; 156/DIG. 26; 156/DIG. 34

[58] Field of Search ..... 118/231, 259, 261; 156/80, 215, 361, 566, 448, 458, 568, 578, DIG. 13, DIG. 26, DIG. 34

[56] References Cited

U.S. PATENT DOCUMENTS

| | | | |
|---|---|---|---|
| 1,575,924 | 3/1926 | McGirr | 156/568 |
| 2,703,660 | 3/1955 | von Hofe et al. | 156/566 |
| 3,126,309 | 3/1964 | Manas et al. | 156/566 |
| 3,294,060 | 12/1966 | McIntyre et al. | 118/261 |
| 3,618,743 | 11/1971 | Benatar et al. | 198/384 |
| 3,717,239 | 2/1973 | Carter | 198/374 |
| 3,762,365 | 10/1973 | Herzog | 118/212 |
| 3,779,829 | 12/1973 | Wolff | 156/361 |
| 3,867,233 | 2/1975 | Eder et al. | 156/571 |
| 4,085,839 | 4/1978 | Crawford | 198/410 |
| 4,343,260 | 8/1982 | Yajima et al. | 118/204 |
| 4,357,370 | 11/1982 | Alheid | 427/211 |
| 4,385,960 | 5/1983 | Zodrow et al. | 156/568 |
| 4,561,377 | 12/1985 | Youngkeit | 118/259 |
| 4,574,020 | 3/1986 | Fosnaught | 156/80 |
| 4,662,965 | 5/1987 | DiFrank et al. | 156/215 |
| 4,693,210 | 9/1987 | DiFrank | 118/231 |
| 4,714,515 | 12/1987 | Hoffman | 156/450 |
| 4,718,373 | 1/1988 | Zodrow | 118/262 |
| 4,781,785 | 11/1988 | Szeremeta | 156/448 |
| 4,931,122 | 6/1990 | Mitchell | 156/215 |
| 5,045,140 | 9/1991 | Dickey | 156/215 |

OTHER PUBLICATIONS

Manufacturer's Brochure, Trine Model 550 G/S Contour Labeling Machine. (not dated).

*Primary Examiner*—Michael G. Wityshyn
*Attorney, Agent, or Firm*—Morgan & Finnegan

[57] ABSTRACT

An apparatus and method for high speed placement of labels onto containers by a continuous motion. The label stock is transferred to a rotary vacuum drum, carried by rotation of the vacuum drum to a glue application station and then to a label application station where the glue coated labels are wrapped onto containers. As the containers reach the labeling position they are already rotating so that their surfaces are moving at the same speed as the drum surface. The labeled containers are then discharged onto a conveyor where they are held against rotation and stabilized by a pair of parallel belt drives.

Glue is imprinted onto each label by a roller with a patterned surface. The roller picks up glue as it rotates past a glue bar surface which emits glue from a tapered exit. The tapered configuration causes build up of suitable pressure so as to force the glue into the pattern on the glue roller. A downstream edge of the glue bar surface acts as a doctor to spread and wipe off excess glue. The excess glue collects in a hollow adjacent to the edge, and may be recirculated.

7 Claims, 3 Drawing Sheets

ULTRA HIGH SPEED LABELING APPARATUS

This is a continuation of co-pending application Ser. No. 07/345,447 filed Apr. 28, 1989, now U.S. Pat. No. 5,045,140.

BACKGROUND OF THE INVENTION

1. Field of the Invention

The invention relates to apparatus and methods for continuous high speed wrapping of labels onto upright containers.

2. Prior Art

Mechanical handling of containers for label application normally includes a number of components integrated to operate as a unit for wrapping a label onto a container. Such apparatus, as disclosed in U.S. Pat. No. 4,242,167, may include a means of label stock supply, a means for cutting label segments, an adhesive assembly for applying adhesive or glue to label segments, a vacuum drum for transfer of the label segments to a position where they are wrapped onto a container, and means for feeding containers to and away from the labeling position. Speed limitations of any one subcomponent have been found to limit the speed of the overall operation. The apparatus of U.S. Pat. No. 4,242,167 is designed to operate at a speed of approximately 100 containers per minute.

It has been discovered that adhesive application methods used in prior apparatus do not accommodate a high speed labeling operation. A glue roller/glue bar assembly is commonly used for imprinting a glue pattern onto labels. As disclosed in U.S. Pat. No. 4,104,845, hot melt adhesive is channeled from a reservoir through a passageway inside a glue "bar". The passageway terminates in a glue deposit portal on the surface of the glue bar, in face-to-face contact with the roller. Glue deposited onto the roller surface becomes increasingly difficult to spread and drain. Excess blue results in uneven, messy printing. In addition, when the apparatus is operated at a speed exceeding 600 containers per minute, the glue may fling off the roller.

Another significant disadvantage of the prior art is that the overall speed of a labeling operation is limited by the discharge conveyor. The rate of discharge must be adjusted to accommodate spinning and instability of exiting containers. As shown in U.S. Pat. Nos. 3,765,991 and 3,834,963 conventional apparatus discharges containers between a single belt positioned opposite a stationary wall. This design, however, imparts additional instability to exiting containers and does not permit container discharge in excess of 600 containers per minute.

It is the object of this invention to achieve high speed labeling of containers by overcoming the disadvantages of the prior art.

It is another object of this invention to avoid such disadvantages by providing an apparatus and method which places labels on containers at high speeds while efficiently spreading and draining glue.

Another object of this invention is to enable a high speed labeling operation by stabilizing exiting containers in order to operate the discharge conveyor at high speeds.

It is a further object of this invention to prevent instability during discharge in order to enable operation at speeds of 1000 or more containers per minute.

SUMMARY OF THE INVENTION

The present invention is directed to a labeling apparatus and method which, in novel fashion, adapts conventional components for high speed continuous placement of labels onto containers. To achieve the objective of applying labels directly onto cylindrical containers at a rapid rate, this invention improves the speed and efficiency of glue application and facilitates rapid container exit by stabilizing container discharge.

The glue application assembly includes means for depositing glue onto a glue roller by a specially designed glue bar which has a tapered glue deposit portal, a trailing edge which acts as a glue wiper, and a hollow groove adjacent the edge which collects excess glue. The taper of the deposit portal, in conjunction with rotational forces of the glue roller, creates sufficient pressures to force glue into grooves between knurls on the roller surface. This allows for rapid rotation of the glue roller and high speed labeling. Glue deposited through the tapered glue portal is spread into an even layer by a lip-like trailing edge on the glue bar while excess glue is collected in the hollow next to the trailing edge.

Stabilizing and rapid discharge of labelled containers are achieved through the use of two parallel belts positioned on opposite sides of a discharge conveyor. The belts address the sides of the spinning containers to dampen rotation and prevent container instability along the discharge conveyor.

According to the invention, these features permit the apparatus to function at a high rate of label application.

BRIEF DESCRIPTION OF THE DRAWINGS

A preferred embodiment of the invention is shown in the drawings wherein.

DETAILED DESCRIPTION OF PREFERRED EMBODIMENTS

Figure 1:
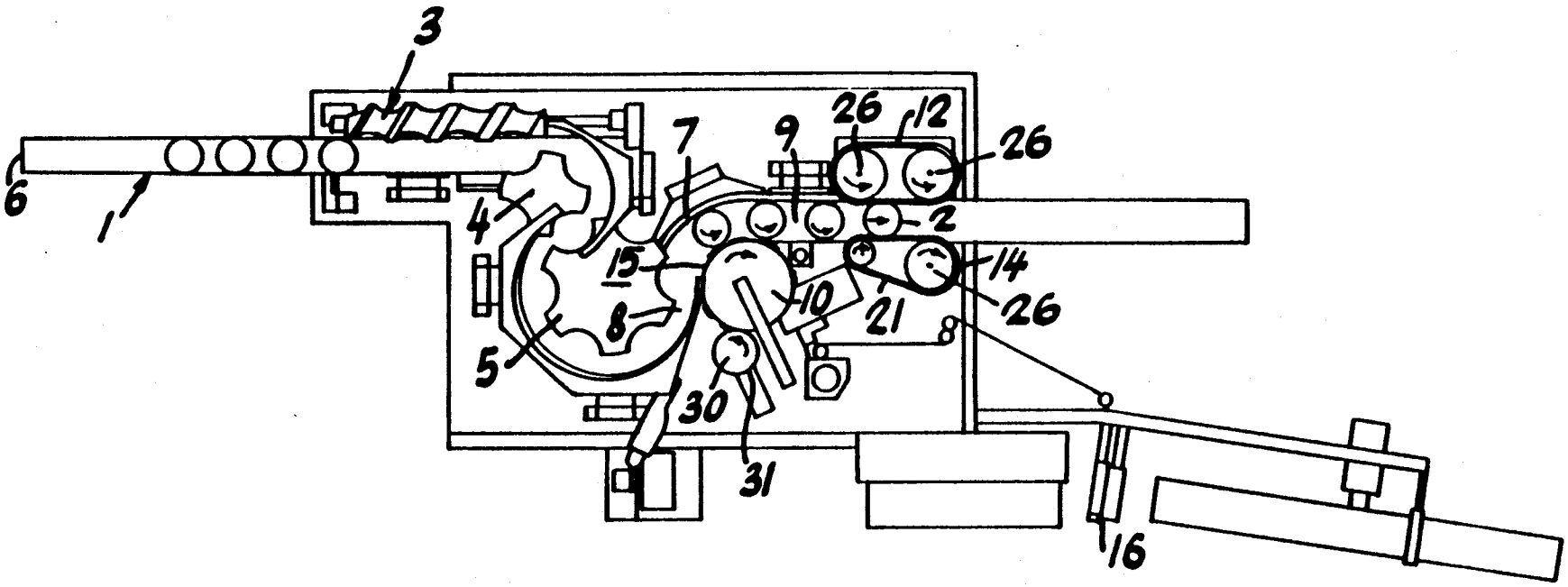
FIG. 1 is a top plan view of the apparatus.
Figure 2:
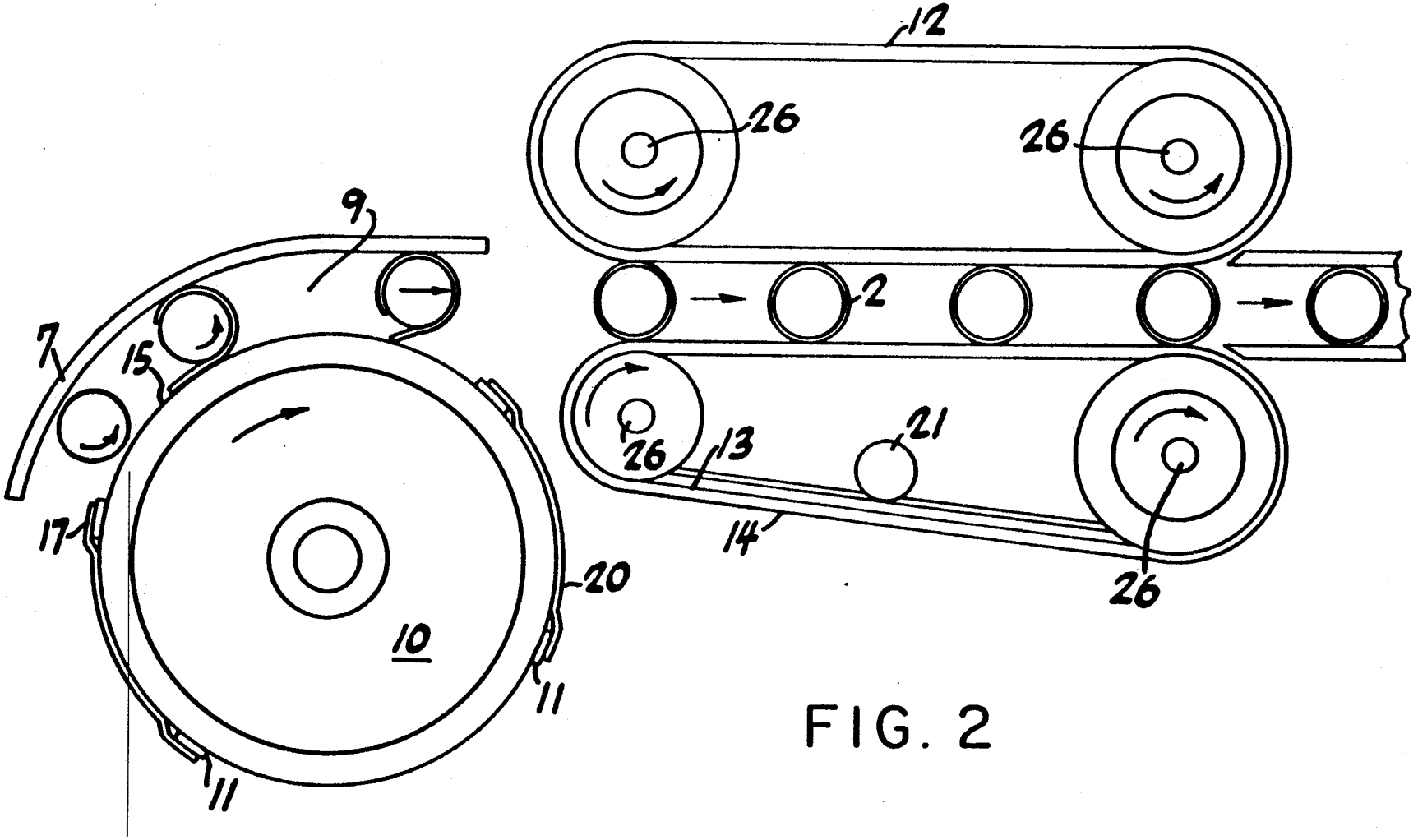
FIG. 2 is an enlarged top plan view of the discharge conveyor and stabilizer belts.

The invention may be further understood by detailed reference to the drawings. As shown in FIGS. 1 and 2, unlabeled containers 1 are conveyed on feed conveyor 6 toward labeling position 15 by a feed screw 3 and two tangentially disposed star wheels 4 and 5. Containers 1 travel freely along conveyor 6 and are carried loosely in the notches of star wheels 4 and 5, along an S-shaped path.

As each container 1 begins its exit from main star wheel 5, it advances between roll on pad 7 and bottle rail 8. A spin is imparted to each container 1 as it tangentially exits the star wheel 5 and bears against roll on pad 7. Once it is spinning, the container is ready for label application.

Vacuum drum 10, positioned in tangent with star wheel 5, carries to labeling position 15 a sequence of glued labels 20 on its surface. As spinning containers reach labeling position 15, labels are wrapped sequentially by contact between the unlabeled containers 1 and the glued leading edge 17 of the label 20 located on protrusion 11 of the vacuum drum 10. After a label is wrapped, the labeled containers 2 continue to spin as they exit onto the discharge conveyor 9.

As shown in FIG. 2, spinning and instability of the labeled containers which would otherwise limit the speed of operation of the apparatus are dampened by dual stabilizer belts 12 and 14. The belts, positioned in parallel along the container discharge path, are driven in opposing directions around posts 26 and press against the sides of the containers to prevent them from spinning. Belts 12 and 14 travel at approximately the same speed as discharge conveyor 9 in order to insure smooth container exit.

Stabilizer belts 12 and 14 are preferably constructed of a plurality of stacked round polyurethane belt members 13. The number of individual belt units on each stabilizer belt can be varied according to the height of containers to be processed on the apparatus. Tension member 21, placed along the belt path ensures proper belt tension.

Referring to the figures, the continuous preparation of label segments is hereinafter described. Label segments are formed by continuously feeding label stock 16 via a roll (not shown) to the vacuum drum 10. Pressure rollers (not shown) advance the stock through a cutter, which continuously severs predetermined lengths of label, while the leading edge 17 of the label 20 is held by suction onto protrusion 11 of vacuum drum 10.

Figure 3:
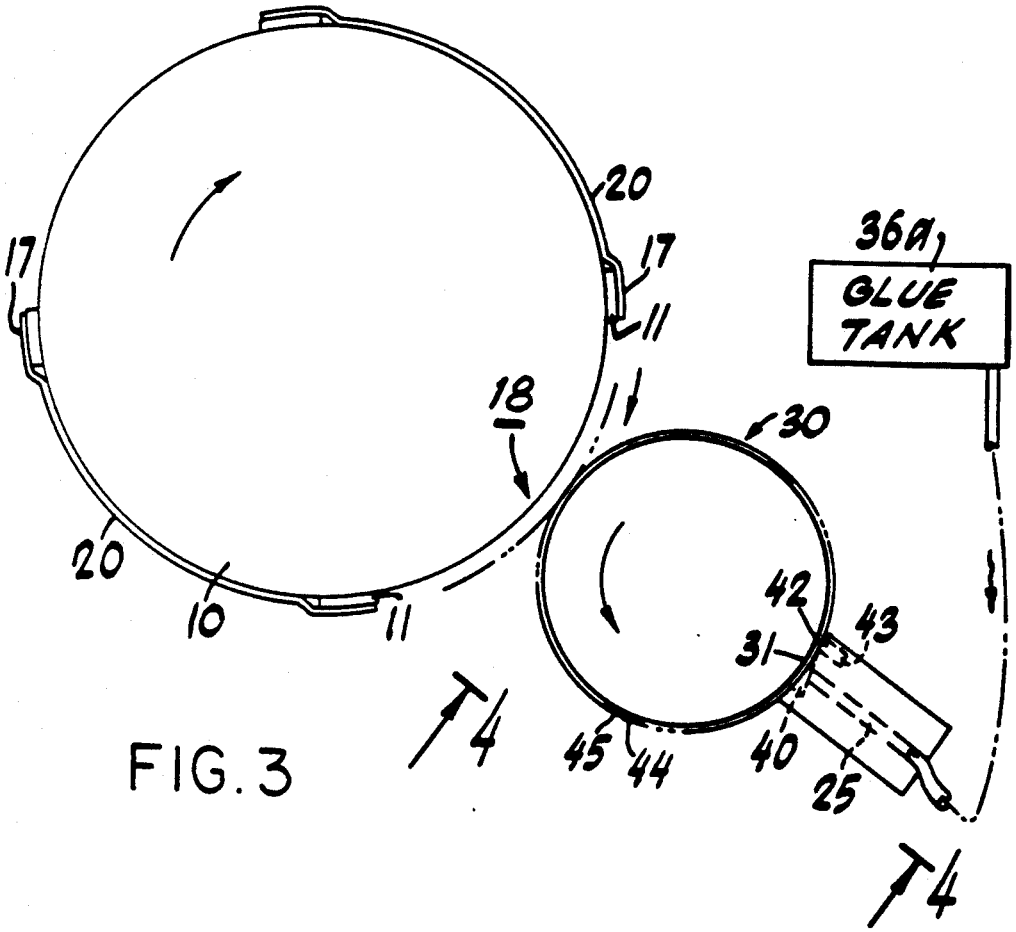
FIG. 3 is a top plan view of the glue roller and glue bar assembly.
Figure 4:
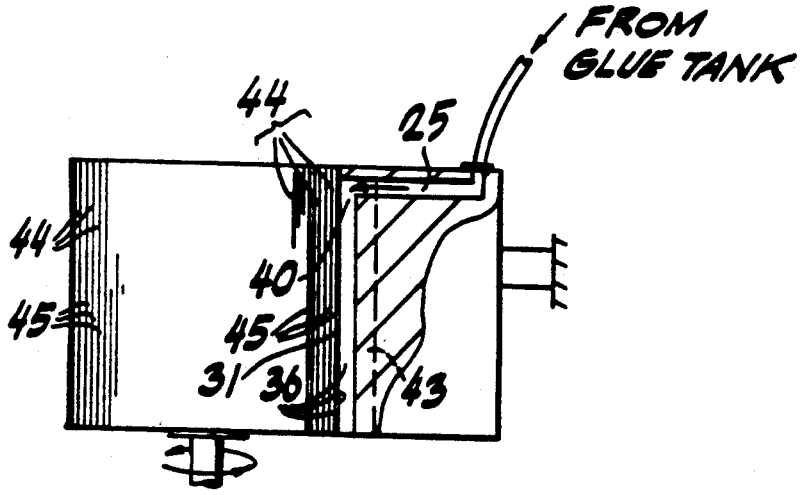
FIG. 4 is a side view along section 4—4 of FIG. 3 of the glue bar and glue roller.

After each label segment 20 is cut, it is positioned on the surface of vacuum drum 10 and rotated through a glue printing position 18 where glue is printed onto the label by glue roller 30 as shown in FIGS. 3 and 4. Protrusions 11 on vacuum drum 10 act as platens for printing of the leading and trailing edges of the label segment. According to the invention, glue may alternatively be printed on only the leading edge of a label, leaving the trailing edge to be attached either to the container or to the leading edge by another means such as solvent or heat bonding.

The glue roller 30 as shown in FIGS. 3 and 4 receives glue from the face of a glue bar 31. Glue 36 is fed from glue tank 36A through internal glue channel 25 to the glue bar face 31 for application to the surface of rotating glue roller 30. Channel 25 leads to a triangular shaped, tapered opening 40 on the glue bar face 31. As glue enters tapered opening 40, the rotation of glue roller 30 causes build up of suitable pressures in the tapered configuration 40 so as to force glue into the patterned surface formed by grooves 44 between knurls 45 on the glue roll 30. Other patterns which result in a similar operation will be apparent to those of ordinary skill in the art.

FIG. 3 shows the taper to be an angle of 15°. This angle refers to the acute angle formed at the intersection of the downstream and phantom sidewalls of the triangular shaped opening. The invention may successfully create suitable pressures at other angles of taper between 5° and 45°. Taper 40 may also peak at a point which is offset from the centerline of glue channel 25. Alternative taper configurations develop varying patterns of pressuring glue into the knurled face of glue roller 30.

Excess glue collects in hollow 43. Edge 42, downstream of the tapered opening 40 on the glue bar face wipes and doctors off excess glue on the surface of glue roller 30 and collects it in vertically disposed hollow 43. The glue is spread by edge 42 and excess glue runs into hollow 43, where it may be collected for recirculation.

While this invention has been described in conjunction with its preferred embodiment, modifications may be made by those skilled in the art without departing from the spirit and scope of the invention as defined in the following claims.

What is claimed is:

1. In an apparatus for the high speed application of label segments to containers with cylindrical wall portions, which includes a glue application roll having an axis of rotation and a cylindrical surface defined by a plurality of knurls having grooves therebetween for applying glue to said label segments, an improved glue supply bar having a concave surface concentric with said roll axis in close proximity and facing relation to said roll surface, comprising:

a glue supply channel terminating in a chamber within the glue bar to form an opening in the concave surface, said opening being concentric with and parallel to the glue application roll axis of rotation, said chamber having a tapered cross-sectional geometry of decreasing volume in the direction of rotation of said roll to force glue under pressure into said grooves on said roll surface, and a hollow formed in the glue bar, said hollow being parallel and adjacent to said chamber similarly forming an opening in the concave bar surface said opening being concentric with and parallel to the glue application roll axis of rotation downstream of said chamber opening, the region of said bar surface located downstream of said hollow being adapted to wipe excess glue from said roll surface into said hollow for collection and removal.

2. The apparatus of claim 1 wherein said chamber has a cross-section that is generally an acute triangle having an acute angle of between about 5° and 45°, and wherein said hollow has a cross-section that is generally rectangular.

3. An apparatus for high speed application of label segments to containers having cylindrical wall portions, comprising:

(a) a cylindrical rotary drum having an axis of rotation for holding and transporting label segments to a label application station;

(b) a glue application roll having an axis of rotation parallel to said drum axis and a cylindrical surface defined by a plurality of knurls having grooves therebetween for applying glue in predetermined patterns onto selected regions of said label segments;

(c) a glue supply bar having a concave surface concentric with said roll axis in close proximity to and facing relation to said roll surface, said bar including a glue supply channel terminating in a chamber within said glue supply bar, said channel forming an opening in said concave surface, said opening being concentric with and parallel to the glue application roll axis of rotation and having a tapered cross-sectional geometry of decreasing volume in the direction of rotation of said roll to force glue under pressure into said grooves on said roll surface, and a hollow formed in said glue bar, said hollow being parallel and adjacent to said chamber and similarly forming an opening in said concave surface, said opening being concentric with and parallel to the glue application roll axis of rotation downstream of said chamber opening, the region of said bar surface downstream of said hollow being adapted to wipe excess glue from said roll surface into said hollow for collection and removal;

(d) conveyor means for continuously feeding in rapid succession said containers to said label application station with their axes parallel to said axis of said drum and their cylindrical wall portions in contact with said label segments on said drum;

(e) means cooperating with said conveyor and said drum for spinning said containers about their axes at said label application station to thereby wrap said label segments around the cylindrical wall portions of said containers;

(f) discharge conveyor means for carrying said labelled containers in rapid succession from said label application station; and (g) means for dampening the spin of said containers while supporting them in an upright stabilized condition as they are carried on and discharged by said conveyor means.

4. The labelling apparatus of claim 3 wherein said chamber has a cross-section that is generally an acute triangle having an acute angle of between about 5° and 45°; and wherein said hollow has a cross-section that is generally rectangular.

5. The labelling apparatus of claim 3 wherein said glue is hot melt glue.

6. The labelling apparatus of claim 3 wherein said means for dampening container spin comprises two parallel drive belts driven in the same direction as said discharge conveyor and positioned on opposite sides thereof so as to press against opposite sides of said labelled containers.

7. The labelling apparatus of claim 6 wherein each of said drive belts includes a plurality of separate belt members.

* * * * *

UNITED STATES PATENT AND TRADEMARK OFFICE

CERTIFICATE OF CORRECTION

PATENT NO. : 5,160,570
DATED : November 3, 1992
INVENTOR(S) : Daniel M. Dickey

It is certified that error appears in the above-indentified patent and that said Letters Patent is hereby corrected as shown below:

Figures 1 and 2 should be deleted to appear as shown on the attached pages.

Signed and Sealed this

Ninth Day of November, 1993

Bruce Lehman

*Attest:*

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,160,570

DATED : November 3, 1992

INVENTOR(S) : Daniel M. Dickey

It is certified that error appears in the above-identified patent and that said Letters Patent is hereby corrected as shown below:

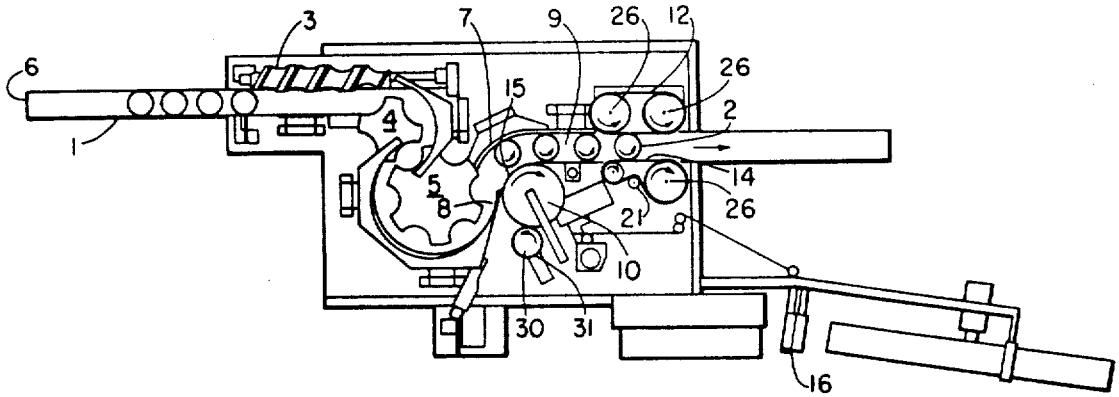

FIG. 1

UNITED STATES PATENT AND TRADEMARK OFFICE

CERTIFICATE OF CORRECTION

PATENT NO. : 5,160,570

DATED : November 3, 1992

INVENTOR(S) : Daniel M. Dickey

It is certified that error appears in the above-identified patent and that said Letters Patent is hereby corrected as shown below:

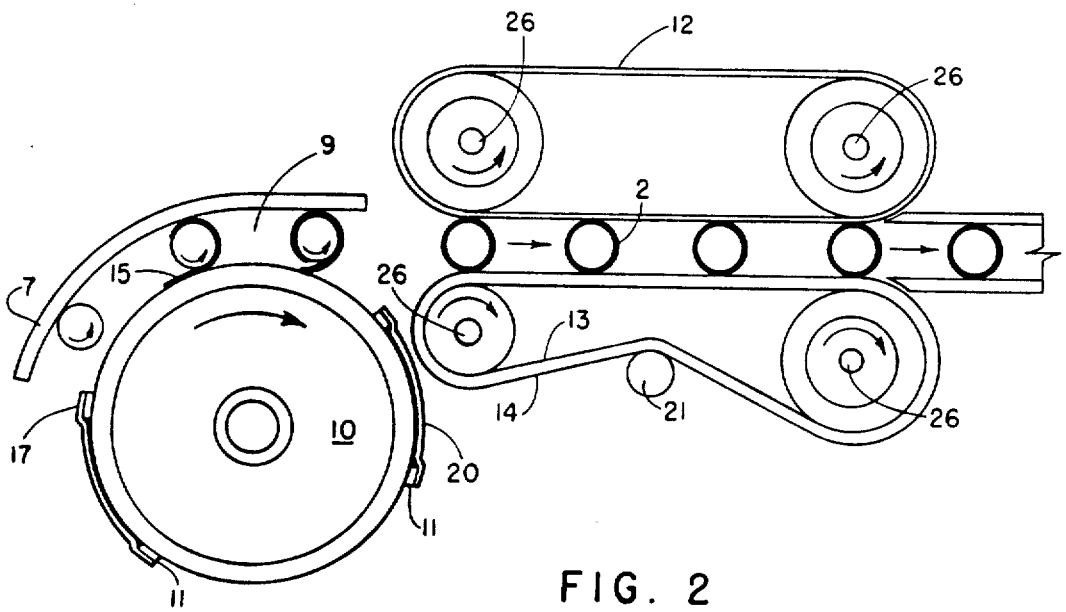

FIG. 2